US006364578B1

(12) United States Patent
Puvilland

(10) Patent No.: US 6,364,578 B1
(45) Date of Patent: Apr. 2, 2002

(54) DEVICE FOR INJECTING GROUT

(75) Inventor: Bernard Puvilland, Nanterre (FR)

(73) Assignee: Compagnie Du Sol, Nanterre (FR)

( * ) Notice: Subject to any disclaimer, the term of this patent is extended or adjusted under 35 U.S.C. 154(b) by 0 days.

(21) Appl. No.: 09/718,547

(22) Filed: Nov. 22, 2000

(30) Foreign Application Priority Data

Dec. 3, 1999 (FR) ..... 99 15260

(51) Int. Cl.[7] ..... E02D 37/00; E04G 23/02
(52) U.S. Cl. ..... 405/269; 52/514.5
(58) Field of Search ..... 405/266–269, 405/258.1, 303; 52/514, 514.5

(56) References Cited

U.S. PATENT DOCUMENTS 4,352,262 A * 10/1982 Edelmann et al. ..... 52/514 X
5,329,740 A * 7/1994 Hayashi et al. ..... 52/514

FOREIGN PATENT DOCUMENTS

EP 0 410 304 B1 1/1991

* cited by examiner

*Primary Examiner*—Thomas B. Will
*Assistant Examiner*—Tara L. Mayo
(74) *Attorney, Agent, or Firm*—Merchant & Gould P.C.

(57) ABSTRACT

The invention relates to a device for injecting material in the form of a suspension into a cavity. The device comprises an injection tube for injecting the material, the tube having a coupling first end and a second end that is open; a coupling has a cylindrical portion provided with an axial bore having a coupling first end for coupling to the first end of the tube, and a second end, said coupling further comprising a radial stub for coupling to a feed pipe for feeding material in suspension; a vent hose is engaged in the said tube and in the coupling, the hose having a first end projecting from the second end of the tube and a second end that projects from the second end of the coupling; and a sealing piece for establishing sealing between the second end of the coupling and the outside wall of said hose.

4 Claims, 2 Drawing Sheets

DEVICE FOR INJECTING GROUT

The present invention relates to a device for injecting a material in the form of a suspension, and in particular a grout, into a cavity.

More precisely, the invention relates to a device making it possible to improve the effectiveness of injection by means of a hollow tube type system into a hole made in a structure in order to treat it. The device is particularly well adapted to treating vaults, i.e. when injection needs to be directed upwards.

BACKGROUND OF THE INVENTION

As shown in FIG. 1, it can be necessary to make a hole 10 in a structure 12 in order to inject grout for treating the structure. With known techniques, grout is injected by means of a tube 14 whose end penetrates into the hole 10, a sealing plug 16 being made, for example, around the tube in order to seal the hole 10 at least temporarily during injection. That system is entirely effective providing the air initially contained in the hole and the cavities within its walls can escape while injection is taking place. Otherwise, when that is not the case, the air becomes compressed inside the hole and injection comes to an end before the hole has been completely filled because of the increase in pressure.

To resolve that problem, proposals have been made to associate the grout injection tube 14 with a vent hose enabling the air held captive in the hole to escape. However, the presence of two tubes passing through the sealing plug 16 makes sealing very difficult or even impossible to obtain. Under such circumstances, water can flow freely between the zones where the two tubes pass through and marks of dampness appear at the plug 16.

OBJECTS AND SUMMARY OF THE INVENTION

An object of the present invention is to provide apparatus for injecting material in the form of a suspension, and in particular a grout, enabling a vent to be put into place simultaneously, but without presenting the above-mentioned drawbacks.

To achieve this object, the invention provides a device for injecting material in the form of a suspension into a cavity, the device comprising:

- an injection tube for injecting said material, the tube having a first end for coupling and a second end that is open to allow said material to escape into said cavity;
- a coupling having a cylindrical portion provided with an axial bore having a first end for coupling to the first end of said tube and a second end, said coupling also having a radial stub;
- a material feed pipe connected to said stub;
- a vent hose engaged in said tube and in said coupling, said vent hose having a first end projecting from the second end of the tube to collect the air contained in said cavity, and a second end that is open to allow the air to escape and that projects from the second end of the coupling; and
- a sealing piece for sealing the second end of said coupling to the outside wall of said hose.

It will be understood that the vent hose passes through the sealing zone at the entrance to the cavity inside the grout injection tube. There is thus only one pipe passage to be sealed. This is made possible by the fact that a sealing piece is fitted to provide sealing between the grout injection tube and the portion of the vent hose that goes to the outside. Nevertheless, the vent function is performed at least as effectively as in the configuration where the vent tube is outside the grout injection tube.

In a first embodiment, the sealing piece has a first end provided with a thread for co-operating with a thread provided at the second end of the coupling, and a second end suitable for taking up a first position in which it clamps in sealed manner against the outside wall of said vent hose and a second position in which it is spaced apart from the wall of said hose.

Also preferably, at rest, said second end of the sealing piece is in its first or clamping position, and the sealing piece further comprises a control member for bringing said second end into its second position.

It will be understood that because of the removable nature of the sealing piece, it is possible to separate the grout injection tube or more precisely its coupling with the vent hose after grout has been injected into the wall.

BRIEF DESCRIPTION OF THE DRAWINGS

Other characteristics and advantages of the invention will appear more clearly on reading the following description of various embodiments of the invention given as non-limiting examples. The description refers to the accompanying figures, in which.

MORE DETAILED DESCRIPTION

Figure 1:
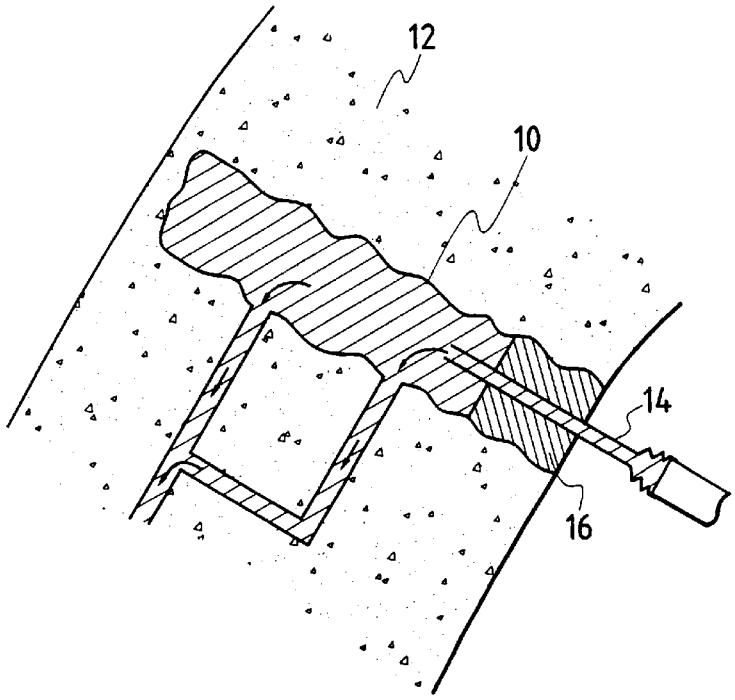
FIG. 1, described above, illustrates the operation of injecting grout into a hole made in a wall.
Figure 2:
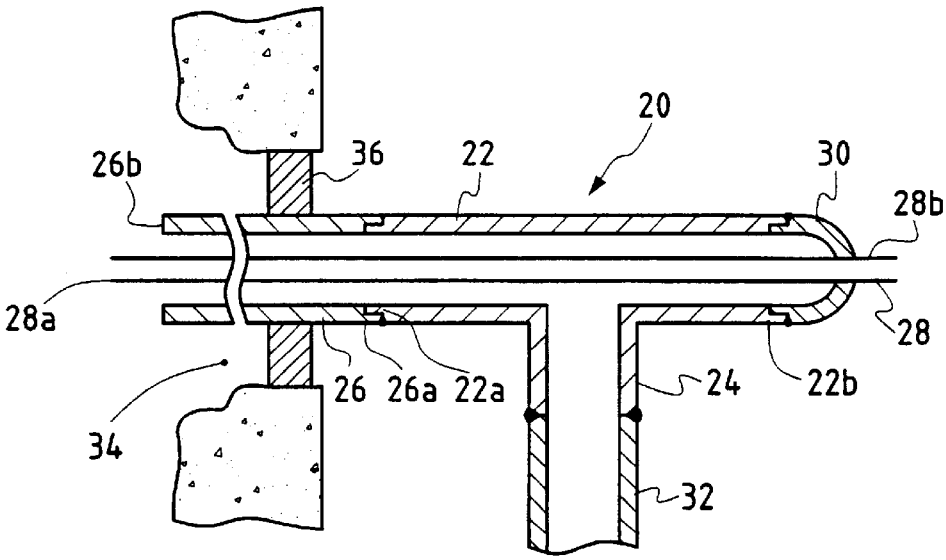
FIG. 2 is a longitudinal section view through a first embodiment of the injection device.

With reference initially to FIG. 2, the injection device is described as a whole. It is constituted by a T-shaped cylindrical coupling referenced 20 and having a cylindrical portion 22 into the side of which there opens a coupling stub 24 that extends in a radial direction. The first end 22*a* of the coupling is, for example, threaded so as to enable it to be fixed to the first end 26*a* of a grout injection tube 26. The second end 26*b* of the tube 26 is naturally open so as to allow the grout to escape into the hole. Inside the assembly constituted by the cylindrical portion 22 of the coupling 20 and by the tube 26, there is mounted a flexible tube or hose 28 of diameter that is substantially smaller than that of the tube 26 and that is designed to serve as a vent. The first end 28*a* of the vent hose 28 projects from the end 26*b* of the tube 26 so as to enable the air contained in the hole to be evacuated. The second end 28*b* of the hose 28 is open so as to allow the air to escape. An annular sealing piece which is described below in greater detail and which is given reference 30 surrounds the hose 28 and provides sealing between the outside wall of the hose 28 and the second end 22*b* of the cylindrical portion 22 of the coupling 20. Finally, a pipe 32 for feeding grout under pressure is mounted on the coupling stub 24. FIG. 2 shows the grout injection device in place in a hole 34, a cement plug 36 providing sealing between the outside face of the tube 26 and the hole 34.

To inject grout, the pipe 32 is fed with grout under pressure. The grout penetrates into the axial bore of the cylindrical portion 22 of the coupling 20 and it is injected into the hole via the tube 26. While this operation is taking place, air contained in the hole can escape via the vent hose 28.

Figure 3:
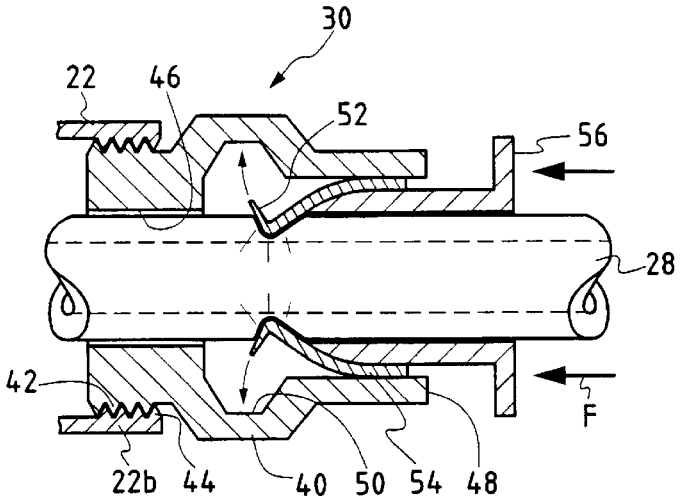
FIG. 3 is a longitudinal section view through a preferred embodiment of the sealing piece.

With reference to FIG. 3, there follows a description of a preferred embodiment of the sealing piece 30 between the end 22*b* of the cylindrical portion 22 of the coupling and the outside wall of the vent-forming hose 28. This piece can take two states. In a first state it is clamped against the outside wall of the tube and provides sealing. In a second state, it is free relative to the hose. Preferably, this piece 30 comprises a cylindrical body 40 having a threaded end 42 that co-operates with tapping 44 formed at the end 52*b* of the coupling 22. The cylindrical body 40 has an axial bore 46 of sufficient diameter to allow the hose 28 to pass through. The cylindrical body 40 has an annular recess 50 towards its open end 48. A ring-shaped resilient element 52 is inserted in the recess 50 and, in its rest position, it has an angled portion 54 bearing against the outside face of the hose 28. Furthermore, this resilient piece is welded at its end 54 to the body 40. Thus, sealing between the cylindrical portion 22 of the coupling 20 and the outside face of the hose 28 is achieved by means of the pressure exerted by the angled portion 58 of the piece 52 against the outside face of the hose 28. This pressure is further increased by the action of the grout under pressure against said piece. A sliding control piece 56 when pressed in the direction of arrow F serves to lift the elastic piece 52 off the hose 28, thereby releasing it.

Figure 4:
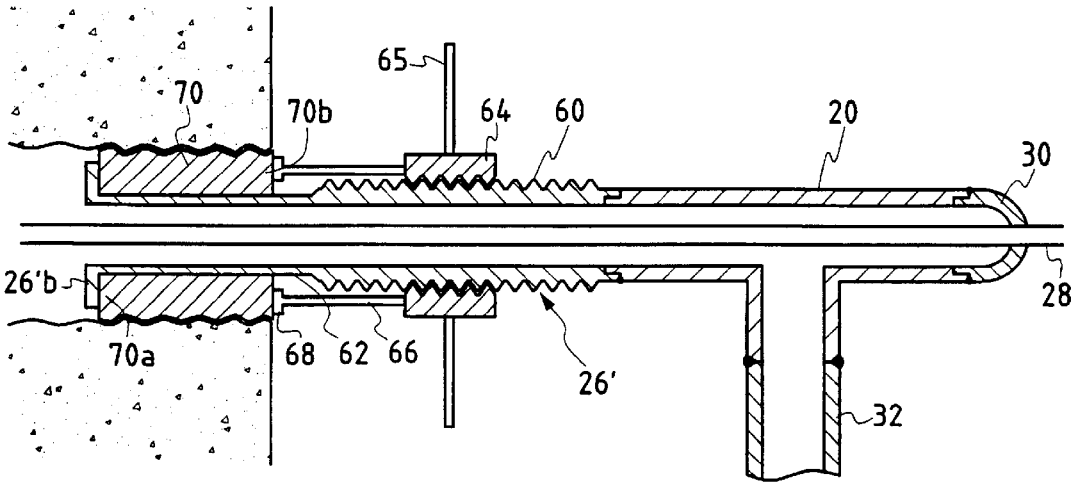
FIG. 4 is a longitudinal section view showing a sealing assembly between the injection tube and the hole made in the wall.

FIG. 4 shows an improved embodiment in which the injection device has its own sealing means between the grout injection tube and the hole in the wall, thus replacing the cement plug 36. In this embodiment, the injection tube, now referenced 26', is made out of a rigid material, e.g. metal. The portion 60 of the injection tube is threaded while its portion 62 close to its end 26'*b* is smooth. A nut 64 is mounted on the threaded portion 60. The nut is fitted with drive bars 65 and with a sleeve 66 surrounding the injection tube and terminating in a bearing member 68. A resilient bushing 70 surrounds the smooth portion 62 of the injection tube. One end 70*a* of the bushing 70 is held against the end 26'*b* of the tube 26', while its other end 70*b* is in contact with the bearing piece 68 of the sleeve 66. It will be understood that by tightening the nut 64, the diameter of the bushing 70 is increased mechanically, thereby providing sealing, or at. least sufficient sealing.

What is claimed is:

1. A device for injecting material in the form of a suspension into a cavity, the device comprising:

an injection tube for injecting said material, the tube having a first end for coupling and a second end that is open to allow said material to escape into said cavity;

a coupling member having a cylindrical portion provided with an axial bore having a first end for coupling to the first end of said tube and a second end, said coupling member also having a radial stub;

a material feed pipe connected to said stub;

a vent hose engaged in said tube and in said coupling member, said vent hose having a first end projecting from the second end of the tube to collect the air contained in said cavity, and a second end that is open to allow the air to escape and that projects from the second end of the coupling member; and a sealing piece for sealing the second end of said coupling member to the outside wall of said hose.

2. A device according to claim 1, wherein said sealing piece has a first end provided with a thread for co-operating with a thread provided at the second end of the coupling member, and a second end suitable for taking up a first position in which it clamps in sealed manner against the outside wall of said vent hose and a second position in which it is spaced apart from the wall of said hose.

3. A device according to claim 2, wherein, at rest, said second end of the sealing piece is in its first or clamping position, and wherein the device further comprises a control member for bringing said second end into its second position.

4. A device according to claim 1, wherein said tube is rigid, and wherein close to its second end said tube has an expandable bushing to provide sealing between said tube and the access orifice to said cavity.

* * * * *